US006026595A

United States Patent [19]

Curry

[11] Patent Number: 6,026,595

[45] **Date of Patent: *Feb. 22, 2000**

[54] METHOD OF MAKING FORM FITTED PRODUCTS

[76] Inventor: John M. Curry, P.O. Box 9040, Bend, Oreg. 97708

[ * ] Notice: This patent issued on a continued prosecution application filed under 37 CFR 1.53(d), and is subject to the twenty year patent term provisions of 35 U.S.C. 154(a)(2).

[21] Appl. No.: 08/873,904

[22] Filed: Jun. 12, 1997

[51] Int. Cl.[7] ..... A43D 9/16; A43B 13/12

[52] U.S. Cl. ..... 36/93; 36/154; 36/88; 12/146 M

[58] Field of Search ..... 36/88, 93, 154, 36/307 A; 12/142 N, 146 M

[56] References Cited

U.S. PATENT DOCUMENTS

| | | | |
|---|---|---|---|
| 1,044,171 | 11/1912 | Guilford | 12/142 N |
| 2,794,270 | 6/1957 | Dubner | 36/154 |
| 3,121,430 | 2/1964 | O'Reilly | 36/154 |
| 3,325,919 | 6/1967 | Robinson | 36/93 |
| 3,903,621 | 9/1975 | Dubner | 36/154 |
| 3,929,140 | 12/1975 | Wesberg | 36/154 |
| 4,128,951 | 12/1978 | Tansill | 36/88 |
| 4,211,019 | 7/1980 | McCafferty | 36/43 |
| 4,399,620 | 8/1983 | Funck | 36/30 R |
| 4,674,206 | 6/1987 | Lyden | 36/88 |
| 4,809,379 | 3/1989 | Jungwirth | 36/93 |
| 5,222,312 | 6/1993 | Doyle | 36/29 |
| 5,353,525 | 10/1994 | Grim | 36/3 B |
| 5,667,738 | 9/1997 | Krajcir . | |
| 5,890,248 | 4/1999 | Gee | 36/30 A |

*Primary Examiner*—M. D. Patterson

[57] ABSTRACT

A new method of making custom fitted products and products made by such a method for improving the fit and comfort of such products. The invention includes incorporating a hollow, sealed envelope into an apparatus, injecting a hardenable, liquid gel-catalyst mixture into the envelope through an inlet, and using a portion of a persons body to apply pressure to the envelope and allowing the mixture to harden while the pressure is being applied. The initially liquid mixture will conform to the shape of the body part which is applying the pressure, and once hardened will provide a product which is specifically shaped to the individual's body part. The product could be a shoe, a safety helmet, protective padding for various parts of the body, handles on tools and implements, and the like.

4 Claims, 3 Drawing Sheets

METHOD OF MAKING FORM FITTED PRODUCTS

BACKGROUND OF THE INVENTION

Field of the Invention

The present invention relates to form fitted products and more particularly pertains to a new method of making form fitted products and products made thereby, for improving the fit and comfort of various products. The method is particularly useful in making shoes, safety helmets, protective padding, handles on tools, and the like.

Description of the Prior Art

The use of form fitted products is known in the prior art. More specifically, form fitted products heretofore devised and utilized are known to consist basically of familiar, expected and obvious structural configurations, notwithstanding the myriad of designs encompassed by the crowded prior art which have been developed for the fulfillment of countless objectives and requirements.

Known prior art form fitted products and methods for making form fitted products include U.S. Pat. No. 5,123,180; U.S. Pat. No. 4,756,096; U.S. Pat. No. 4,520,581; U.S. Pat. No. 4,942,679; U.S. Pat. No. 3,871,117; and U.S. Patent Des. 349,393.

While these devices fulfill their respective, particular objectives and requirements, the aforementioned patents do not disclose a new form fitted product and method of making the form fitted product. The inventive method includes incorporating a hollow, sealed envelope into an apparatus, injecting a hardenable, liquid gel-catalyst mixture into the envelope through an inlet, and using a portion of a persons body to apply pressure to the envelope and allowing the mixture to harden while the pressure is being applied. The initially liquid mixture will conform to the shape of the body part which is applying the pressure, and once hardened will provide a product which is specifically shaped to the individual's body part. The product could be a shoe, a safety helmet, protective padding for various parts of the body, handles on tools and implements, and the like.

In these respects, the custom fitted apparatus and associated method according to the present invention substantially departs from the conventional concepts and designs of the prior art, and in so doing provides a method and apparatus primarily developed for the purpose of improving the fit and comfort of hand held or body supported/worn products.

SUMMARY OF THE INVENTION

In view of the foregoing disadvantages inherent in the known types of form fitted products now present in the prior art, the present invention provides a new custom fitted product and method of making for improving the fit and comfort of hand held or body supported/worn apparatus.

The general purpose of the present invention, which will be described subsequently in greater detail, is to provide a new method of making custom fit products and products made thereby which has many of the advantages of the methods and products mentioned heretofore and many novel features that result in a new method which is not anticipated, rendered obvious, suggested, or even implied by any of the prior art methods, either alone or in any combination thereof.

To attain this, the present invention generally comprises a method which includes incorporating a hollow, sealed envelope into an apparatus, injecting a hardenable, liquid gel-catalyst mixture into the envelope through an inlet, and using a portion of a persons body to apply pressure to the envelope and allowing the mixture to harden while the pressure is being applied. The initially liquid mixture will conform to the shape of the body part which is applying the pressure, and once hardened will provide a product which is specifically shaped to the individual's body part. The product could be a shoe, a safety helmet, protective padding for various parts of the body, handles on tools and implements, and the like.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new method of making a form fitted apparatus and an apparatus made thereby which has many of the advantages of the methods and products mentioned heretofore and many novel features that result in a new method of making a form fitted apparatus which is not anticipated, rendered obvious, suggested, or even implied by any of the prior art methods, either alone or in any combination thereof.

It is another object of the present invention to provide custom fitted products which may be easily and efficiently manufactured and marketed.

It is a further object of the present invention to provide custom fitted products which are of a durable and reliable construction.

An even further object of the present invention is to provide custom fitted products which are susceptible of a low cost of manufacture with regard to both materials and labor, and which accordingly is then susceptible of low prices of sale to the consuming public, thereby making such custom fitted products economically available to the buying public.

Still yet another object of the present invention is to provide custom fitted products and method of making which provides in the apparatuses and methods of the prior art some of the advantages thereof, while simultaneously overcoming some of the disadvantages normally associated therewith.

Still another object of the present invention is to provide new custom fitted products for improving the fit and comfort of hand held or body supported/worn apparatus.

Yet another object of the present invention is to provide a new custom fitted shoe which is made by the method which includes incorporating a hollow, sealed envelope into an apparatus, injecting a hardenable, liquid gel-catalyst mixture into the envelope through an inlet, and using a portion of a persons body to apply pressure to the envelope and allowing the mixture to harden while the pressure is being applied. The initially liquid mixture will conform to the shape of the body part which is applying the pressure, and once hardened will provide a product which is specifically shaped to the individual's body part. The product could be a shoe, a safety helmet, protective padding for various parts of the body, handles on tools and implements, and the like. The inventive method is particularly suited for making form fitted shoes.

Still yet another object of the present invention is to provide new custom fitted shoes, safety helmets, protective padding, and tool handles that give optimum comfort, fit, and cushioning.

Even still another object of the present invention is to provide new custom fitted shoes, safety helmets, protective padding, and tools that eliminates the routine of returning these items to the place of purchase due to poor fit and/or uncomfortable size.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
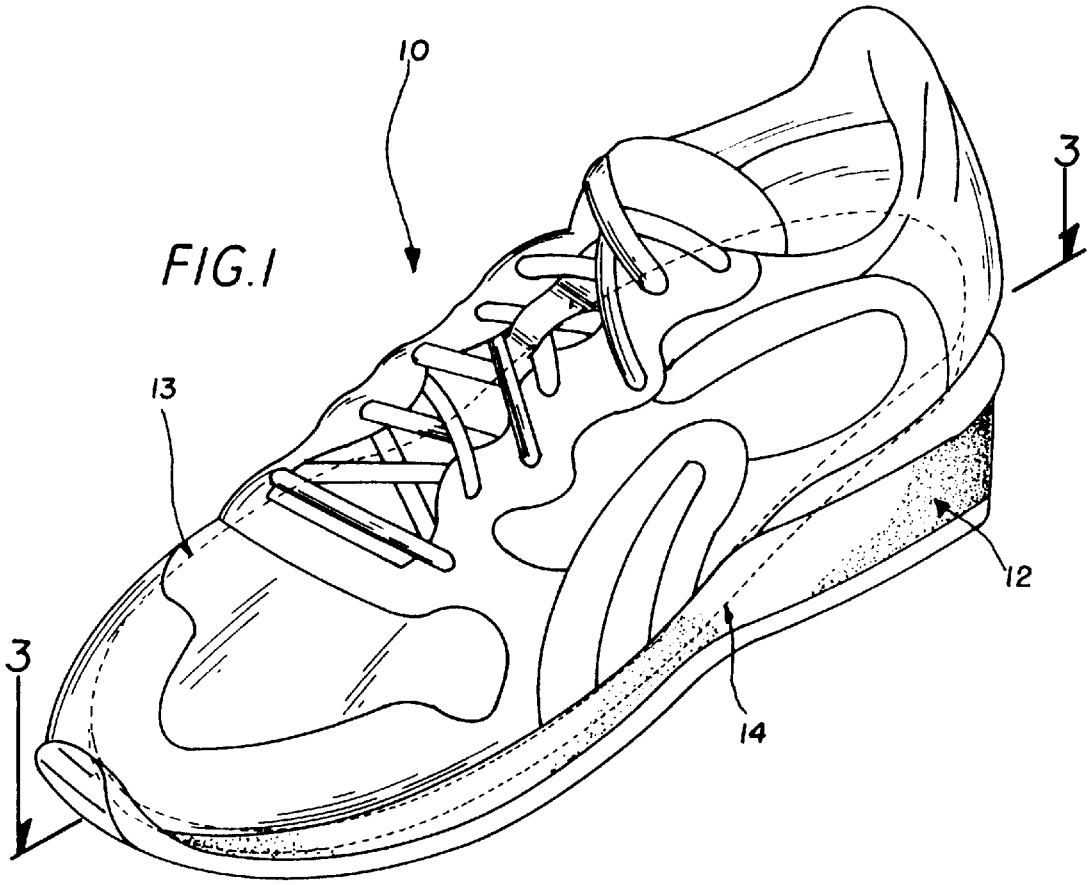
FIG. 1 is a perspective view of a new custom fitted shoe made according to the method of the present invention.
Figure 2:
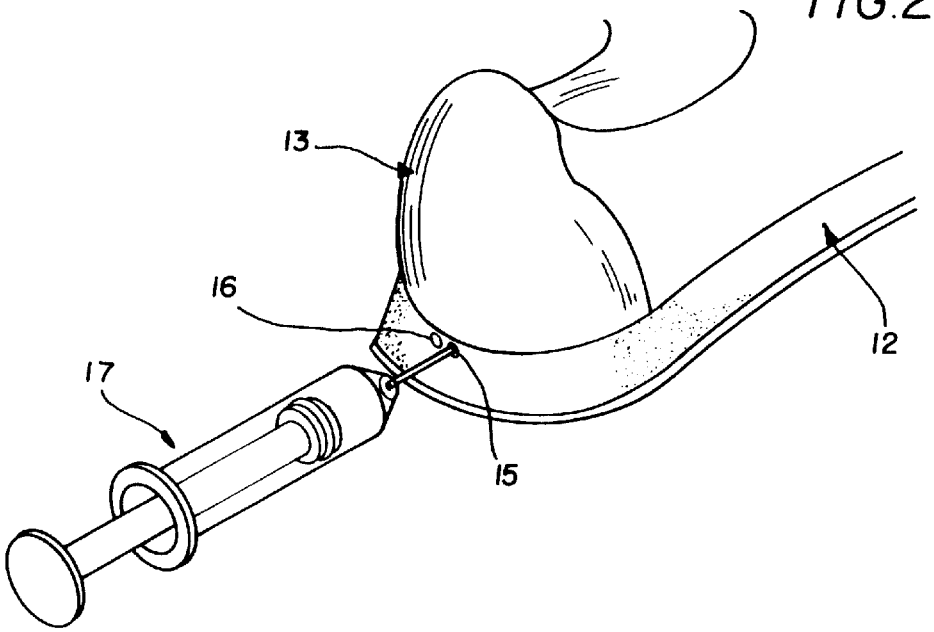
FIG. 2 shows the step of filling the envelope with the hardenable mixture through the rear of the shoe.
Figure 3:
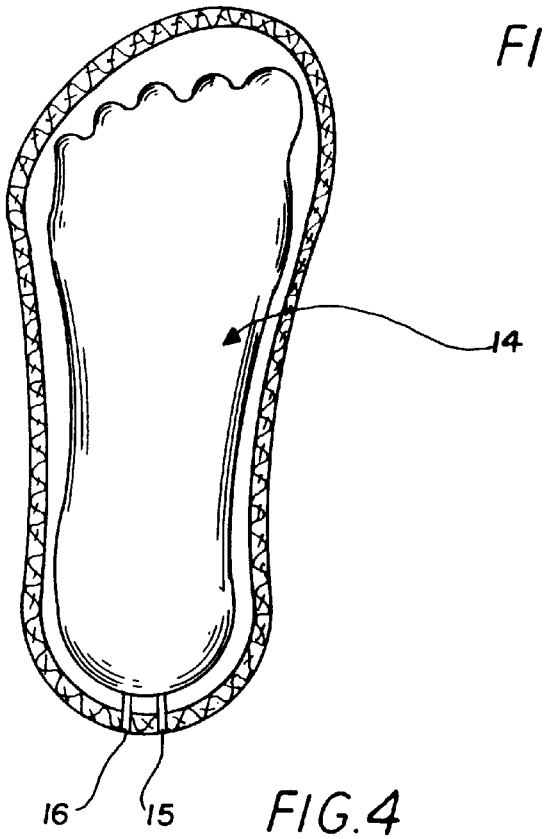
FIG. 3 is a sectional view taken along line 3-3 of FIG. 1.
Figure 4:
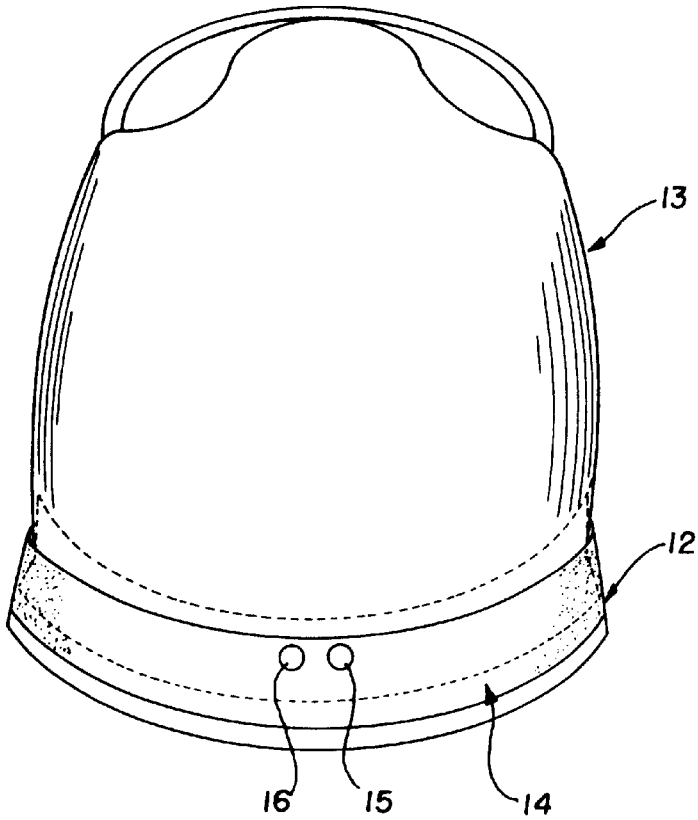
FIG. 4 is a rear view of the shoe.

The inventive method is shown and described herein with respect to a form fitted shoe. It should be realized however that the method described herein is applicable to other body supported/worn, or hand held, products. With reference now to the drawings, and in particular to FIGS. 1 through 4 thereof, a new custom fitted shoe embodying the principles and concepts of the present invention and generally designated by the reference numeral 10 will be described.

As best illustrated in FIGS. 1 through 4, the custom fitted shoe 10 includes a sole 12 and an upper 13 connected to the sole. The shoe 10 can be any type of athletic shoe, casual shoe, dress shoe, boot, etc. in which optimum fit and comfort is desirable. The shoe 10, for purposes of illustration, is shown as being a running shoe.

The shoe 10, during its manufacture, has a hollow envelope or bag 14 integrally incorporated therein as part of its construction. The envelope 14 is preferably incorporated into both the sole 12 and the upper 13, although the envelope could be incorporated solely into the sole 12 or the upper 13. The term "incorporated" as used throughout the specification and claims means that the envelope is suitably provided as part of the construction of the sole 12 and/or the upper 13. Preferably, the envelope is disposed within the shoe such that it does not come into direct contact with the skin of the wearer. For instance, a cloth or fabric layer could cover the envelope 14 so that the layer protects the wearers skin from direct contact with the envelope.

The envelope 14 is made of a tough, long lasting, flexible material, such as a plastic material. The envelope 14 defines a generally hollow, sealed chamber which is later filled with a hardenable mixture. An inlet port 15 leads from the envelope and extends through the sole 12 of the shoe, in the heel area thereof, so as to permit filling of the envelope. Similarly, outlet port 16 leads from the envelope and extends through the sole, adjacent the inlet port 15. The outlet port 16 permits escape of air and mixture from the envelope.

The shoe 10 is intended to be sold with the envelope 14 empty. Upon purchase of the shoe, a hardenable mixture would be injected into the envelope through the inlet port by a suitable injecting device 17 so as to fill the envelope. The outlet port 16 permits the escape of air from the envelope during the filling procedure, and when the mixture starts coming out the outlet, provides an indication that the envelope is full.

The hardenable mixture is preferably one which hardens to desired parameters within a few minutes. The type of mixture used is also selected to provide the desired softness and comfort to the wearer upon hardening, while having sufficient durability. The mixture preferably comprises a liquid gel, silicone, or rubber substance in combination with a suitable catalyst to initiate hardening.

The shoe 10 is made by the following procedure: After the shoe is made with the envelope incorporated into the sole and/or upper thereof, a purchaser buys the shoe. At this point, the hardenable mixture is injected into the envelope through the inlet, until the mixture starts coming out the outlet port, which indicates that the envelope is filled. The injection is stopped and the purchaser puts the shoe on and stands up. The mixture within the envelope will conform to the wearer's foot, with the excess running out of the outlet port for disposal. The mixture is then allowed to harden, at which point the shoe will conform to the wearer's foot, to provide optimum fit.

Figure 5:
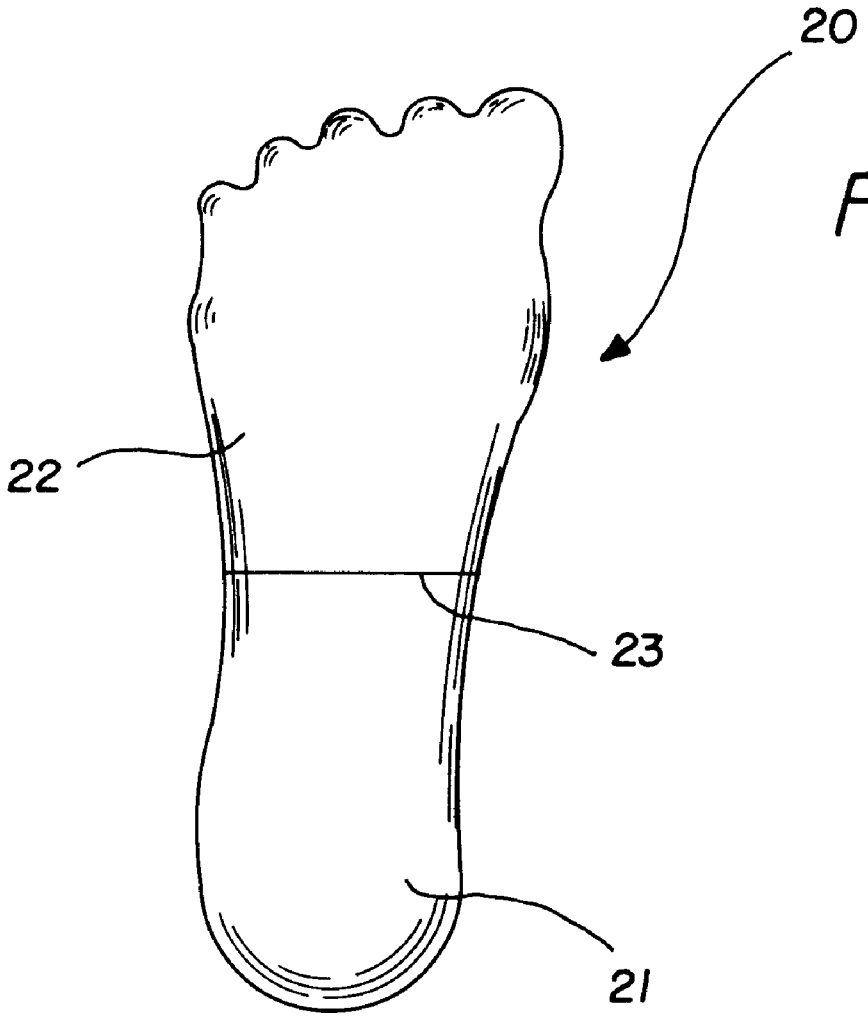
FIG. 5 is a top view of a multi-chambered envelope.

Instead of injecting the mixture into the envelope, the envelope could be formed in the shoe such that it comes included with the gel, silicone, or rubber provided in a separate chamber within the envelope from the catalyst. FIG. 5 illustrates such an envelope 20, which includes two chambers 21,22 separated by a thin, breakable membrane 23. Upon purchase, the user would break the membrane permitting the two materials to mix together. The wearer would then put on the shoe and allow the mixture to harden.

The invention as described herein is useful in a variety of products and applications other than shoes, such as safety helmets, protective padding like knee and elbow pads, tools with handles, splints and casts, insulation and sound proofing products, and for filling holes, cracks, and dents.

For helmets, the envelope 14,20 (or envelopes) would be suitably incorporated into the lining of the helmet, and the mixture allowed to harden while the helmet is worn on the users head. If the envelope 14 is used, inlets and outlets would be suitably provided either on the inside or outside of the helmet to allow injection and escape of the mixture. With protective padding, the envelope(s) would be appropriately located therein, and the padding would be worn by the user during the hardening process. With a tool handle, the envelope would be formed on the outside of the handle, and the user grips the envelope during the hardening process to form the handle to the users hand.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A form fitted shoe kit comprising:

a syringe including a cylinder having a first end with a larger opening and a second end with a smaller opening, a needle member extending from and in communication with the smaller opening of the cylinder, and a plunger extending through the larger opening of the cylinder;

a hardenable liquid mixture for placing in the cylinder of the syringe, the hardenable liquid mixture comprising at least one substance selected from the group including a liquid gel, a silicone, and a rubber; and a catalyst adapted to cause hardening of the substance;

a shoe having and front and a rear, the shoe including a sole and an upper connected to the sole, the sole having a front portion and a heel portion, the sole having an outer perimeter wall defining a single hollow chamber within the sole, the outer perimeter wall having a pair of apertures therethrough at the rear of the shoe;

a sealed envelope positioned in the hollow chamber within the outer perimeter wall of the sole of the shoe, the sealed envelope defining an interior adapted for receiving the hardenable liquid mixture; and a fabric layer covering an exterior surface of the sealed envelope;

wherein the sealed envelope has an inlet into the interior of the sealed envelope and an outlet out of the interior of the sealed envelope, the inlet extending through one of the apertures in the outer perimeter wall of the sole and the outlet extending through the other of the apertures in the outer perimeter wall of the sole, the outlet providing an exit for excess hardenable liquid mixture from the envelope; and wherein the needle member of the syringe is adapted to be inserted through the aperture in communication with the inlet into the sealed envelope of the sole such that injection of the hardenable liquid mixture may be effected through the aperture and into the interior of the envelope while a foot of a user is positioned in the shoe on top of the sealed envelope for conforming a top surface of the sealed envelope to the contours of the lower surface of the user's foot, wherein the outlet of the envelope is adapted to permit excess mixture to exit the envelope for the envelope to adapt to the contours of the user's foot.

2. A form fitted shoe system comprising:

a hardenable liquid mixture for placing in a cylinder and a syringe, the hardenable liquid mixture comprising at least one substance selected from the group including a liquid gel, a silicone, and a rubber; and a catalyst adapted to cause hardening substance;

a shoe having and front and a rear, the shoe including a sole and an upper connected to the sole, the sole having a front portion and a heel portion, the sole having an outer perimeter wall defining a single hollow chamber within the sole, the outer perimeter wall having a pair of apertures therethrough at the rear of the shoe; and a sealed envelope positioned in the hollow chamber within the outer perimeter wall of the sole of the shoe, the sealed envelope defining an interior adapted for receiving the hardenable liquid mixture;

wherein the sealed envelope has an inlet into the interior of the sealed envelope and an outlet out of the interior of the sealed envelope, the inlet extending through one of the apertures in the outer perimeter wall of the sole and the outlet extending through the other of the apertures in the outer perimeter wall of the sole; and wherein the aperture in communication with the inlet into the sealed envelope is adapted to receive a needle member of a syringe such that injection of the hardenable liquid mixture may be effected through the aperture and into the interior of the envelope while a foot of a user is positioned in the shoe on top of the sealed envelope for conforming a top surface of the sealed envelope to the contours of the lower surface of the user's foot.

3. The system of claim 2 additionally comprising a syringe including a cylinder having a first end with a larger opening and a second end with a smaller opening, a needle member extending from and in communication with the smaller opening of the cylinder, and a plunger extending through the larger opening of the cylinder, the cylinder being adapted to receive the hardenable liquid mixture.

4. The system of claim 2 additionally comprising a fabric layer covering an exterior surface of the sealed envelope.

* * * * *